United States Patent [19]

Liu

[11] 3,963,141

[45] June 15, 1976

[54] CLOSURE CAP WITH SELF-OPENING MEANS

[76] Inventor: Ming-Jen Liu, 152, Wen Wu Erh St., Chien Chin District, Kao Hsiung, China /Taiwan

[22] Filed: May 21, 1975

[21] Appl. No.: 579,439

[52] U.S. Cl. ..... 215/254; 215/305

[51] Int. Cl.[2] ..... B65D 41/12

[58] Field of Search ..... 215/249, 247, 250, 253, 215/254, 255, 256, 305; 220/268, 270

[56] References Cited

UNITED STATES PATENTS

| | | | |
|---|---|---|---|
| 1,612,927 | 1/1927 | Kuhne | 215/255 |
| 2,135,386 | 11/1938 | Crabbe | 215/247 |
| 2,974,815 | 3/1961 | Driscoll | 215/253 X |
| 3,278,063 | 10/1966 | Kranzhoff | 215/247 X |
| 3,379,326 | 4/1968 | Andersen | 215/249 |
| 3,587,897 | 6/1971 | Rohde | 215/249 |

*Primary Examiner*—Donald F. Norton

[57] ABSTRACT

A self-opening closure cap for containers. The cap has a hole at its central portion and a self-opening means integrally formed with a seal placed under the cap and protruding therefrom through the hole. In one embodiment the self-opening means and seal are injection molded of polyethylene or polypropylene. When a pulling force is exerted on the self-opening means by a finger, the core of the seal will be punctured so that the contents are removable through the hole without using any mechanical opener and without removing the whole cap.

3 Claims, 4 Drawing Figures

CLOSURE CAP WITH SELF-OPENING MEANS

BACKGROUND OF THE INVENTION

This invention relates to a self-opening closure cap for bottles or other containers, more particularly to a closure cap having a hole at the central portion thereof and forming a self-opening means integrally formed with the seal placed under the cap and protruded therefrom through the hole.

In the prior art, a large number of bottles or other containers for carrying beverages such as beer, juice, or the like have been closed by a crown cap or a similar closure device which can generally only be properly removed by the use of a suitable tool, such as a mechanical opener. Similarly, where metal containers are used, mechanical devices are necessary to puncture the end of the can to remove its contents. In either circumstance, it is a great inconvenience to the user to attempt to open such a device when a mechanical device or opener is not at hand or is otherwise not operative or available.

In an attempt to solve these problems, a number of methods have been suggested in the prior art, such as those shown and described in the U.S. Pat. Nos. 1,127,357; 1,180,864; 2,426,101; 2,426,102 and 3,199,706. In the devices described in these patents, generally a pull ring or a tab is provided and integrally shaped with the cap for enabling one to exert a pulling force wherby the closure cap will be removed. In fact, the cap should be closed tightly to prevent leakage so that it can hardly be pulled off by finger. For this main reason, none of the caps described in the mentioned patents are useful.

SUMMARY OF THE INVENTION

Accordingly, it is an object of this invention to provide a self-opening closure cap for a bottle or other container which is readily opened by hand without any tool.

It is another object of this invention to provide such a closure cap having a hole at its central portion and providing a self-opening means integrally formed with the seal placed under the cap and protruded therefrom through the said hole.

It is a further object of this invention to provide such a closure cap wherein the self-opening means and the seal is integrally formed, for example, by injection molding of non-toxic resilient thermoplastic resins, such as polyethylene or polypropylene and the like.

It is a still further object of this invention to provide the aforementioned closure cap wherein the self-opening means is formed as a pull ring or tab.

These and other objects of this invention will become apparent from a review of the accompanying written description of the invention taken in conjunction with the drawings.

DETAILED DESCRIPTION OF THE PREFERRED EMBODIMENT

Figure 1:
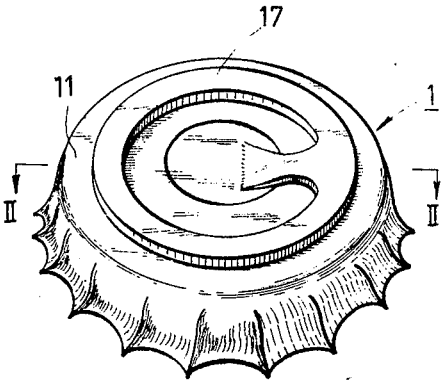
FIG. 1 is a perspective view of an embodiment of the closure cap according to the present invention.
Figure 2:
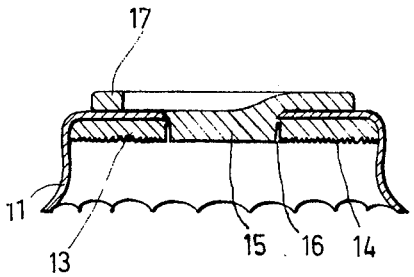
FIG. 2 is a cross-sectional view taken along line II—II of FIG. 1
Figure 3:
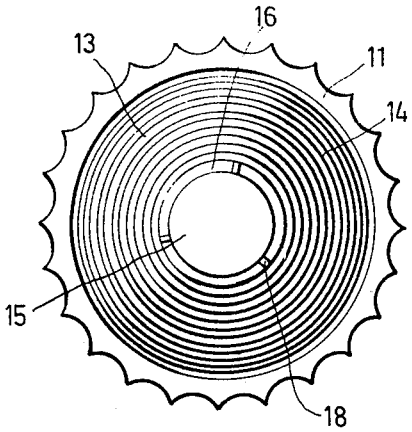
FIG. 3 is a bottom view of the closure cap shown in FIG. 1.
Figure 4:
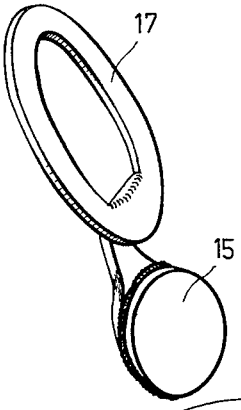
FIG. 4 is a perspective view depicting the cap after the self-opening means is removed.
Figure 4:
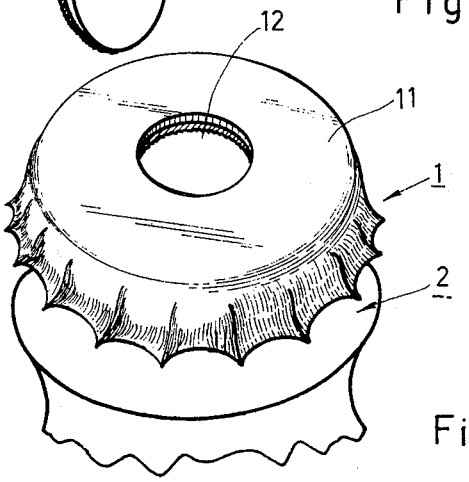

Referring to FIGS. 1 through 4, a self-opening closure cap 1 for a bottle 2 or other containers comprises a metal crown cap body 11 having a hole 12 at its central portion. Under the cap 11 is a seal 13 with a plurality of annular striation 14 for increasing the friction and improve the sealing between the seal 13 and the top edge of bottle 2 when the cap 1 is tightly closed on a bottle mouth. The seal 13 includes a core portion 15 of flat surface, which is in coincidence with the hole 12 of the cap 11. A groove 16 is formed at the boundary between the core 15 and outer annular portion. A self-opening means 17, such as a ring-shaped gripping member, is formed above the metal crown cap body 11 and connected to the core portion 15 through the hole 12. The self-opening means 17 and seal 13 are integrally formed, for example, by injection molding in one step. Therefore, the material of the self-opening means 17 is the same as that of the seal 13, i.e., a non-toxic resilient thermoplastic resin, preferably polyethylene and/or polypropylene. Alternatively, the groove 16 may be intermittent at least at one location 18, although three locations are preferred.

In opening the closure cap of the present invention, the user need only pull the ring-shaped or tab-formed (not shown) self-opening means 17 to a certain extent to puncture the seal 13 along the groove 16 which is the most weak trace. Then the hole 12 of metal crown cap body 11 is exposed so that the contents can be optionally poured out or sucked with a straw or the like. When the bottle 2 contains a beverage with carbon dioxide, the intermittent point 18 of the groove 16 will be particularly useful for slightly obstructing the progress of the puncture in order to let a part of the contained carbon dioxide gases escape before the seal 13 haS been completely punctured. In this manner, the closure cap is readily opened by the use of a bare hand without requiring any kind of mechanical opener.

In the foregoing, preferred embodiments of the present closure cap have been shown and described. However, it is to be understood that this invention is not to be limited by these embodiments, but is to be limited only by the appended claims.

What I claim is:

1. A self-opening closure cap for a container comprising:

a metal crown cap body having a hole at the central portion thereof;

a seal placed under said cap body for creating a fluid-tight seal between said cap body and said container, and having a core portion in coincidence with said hole of said cap body; and a ring shaped portion integral with said seal placed above said cap body and connected to said core portion of said seal through said hole of said cap body, said core portion being severable from said seal upon the application of a pulling force on said ring-shaped portion to thereby expose the contents of said container through said hole.

2. The closure cap as defined in claim 1, including a groove at the boundary between said core portion and the outer annular portion of said seal.

3. The closure cap as defined in claim 2, wherein said groove is intermittent at least at one location.

* * * * *